US011236929B2

(12) United States Patent
Kim et al.

(10) Patent No.: US 11,236,929 B2
(45) Date of Patent: Feb. 1, 2022

(54) EXHAUST DUCT DETACHABLE FROM OUTLET, WATER-HEATING DEVICE HAVING THE EXHAUST DUCT, AND METHOD FOR REPAIRING THE WATER-HEATING DEVICE

(71) Applicant: KYUNGDONG NAVIEN CO., LTD., Gyeonggi-do (KR)

(72) Inventors: Jeong Woo Kim, Seoul (KR); Sung Cheul Cho, Seoul (KR)

(73) Assignee: Kyungdong Navien Co., Ltd., Gyeonggi-do (KR)

( * ) Notice: Subject to any disclaimer, the term of this patent is extended or adjusted under 35 U.S.C. 154(b) by 125 days.

(21) Appl. No.: 16/525,332

(22) Filed: Jul. 29, 2019

(65) Prior Publication Data

US 2020/0056810 A1 Feb. 20, 2020

(30) Foreign Application Priority Data

Aug. 14, 2018 (KR) ..... 10-2018-0094937

(51) Int. Cl.
*F23J 13/04* (2006.01)
*F24H 9/14* (2006.01)
(Continued)

(52) U.S. Cl.
CPC ..... *F24H 9/146* (2013.01); *F24H 1/206* (2013.01); *F24H 9/0005* (2013.01); *F24H 9/02* (2013.01);
(Continued)

(58) Field of Classification Search
CPC ... F24H 9/18; F24H 1/205; F23J 11/00; F22B 13/02; F22B 37/06
See application file for complete search history.

(56) References Cited

U.S. PATENT DOCUMENTS 3,560,027 A * 2/1971 Graham ..... F16L 41/03 285/130.1
4,000,886 A * 1/1977 Johnson ..... C21C 5/40 266/147
(Continued)

FOREIGN PATENT DOCUMENTS

EP 2354615 A1 * 8/2011 ..... F23J 13/04
JP 5146635 B2 8/2008
(Continued)

OTHER PUBLICATIONS

Office Action of corresponding Korean Patent Application No. 10-2018-0094937 dated Sep. 3, 2020, 4 pages.
(Continued)

*Primary Examiner* — Gregory A Wilson
(74) *Attorney, Agent, or Firm* — Wegman Hessler

(57) ABSTRACT

An exhaust duct includes an upper duct being open at opposite ends thereof and a lower duct being open at a tip end thereof. One end of the upper duct is connected, inside an enclosure of a water-heating device, to an exhaust adaptor disposed on the enclosure, and an opposite end of the upper duct communicates with the tip end of the lower duct. The upper duct is connected to the lower duct so as to be slidable along a reference direction in which the lower duct extends from the tip end of the lower duct, and the upper duct is configured to be separated from the exhaust adaptor by sliding along the reference direction.

15 Claims, 9 Drawing Sheets

(51) Int. Cl.

| | |
|---|---|
| ***F24H 1/20*** | (2006.01) |
| ***F24H 9/02*** | (2006.01) |
| ***F24H 9/18*** | (2006.01) |
| ***F24H 9/00*** | (2006.01) |

(52) U.S. Cl.
CPC ..... *F24H 9/1836* (2013.01); *F24H 2210/00* (2013.01)

(56) References Cited

U.S. PATENT DOCUMENTS

| | | | | |
|---|---|---|---|---|
| 4,494,598 | A * | 1/1985 | DeHaan | F24H 8/006 165/47 |
| 5,341,797 | A | 8/1994 | Maruyama | |
| 6,811,190 | B1 * | 11/2004 | Ray | F23J 13/04 285/361 |
| 8,881,689 | B2 * | 11/2014 | Kameyama | F24H 9/0026 122/19.2 |
| 9,989,252 | B2 * | 6/2018 | Nagano | F24H 9/1836 |
| 10,088,156 | B2 * | 10/2018 | Leung | F23J 13/04 |
| 10,337,735 | B2 * | 7/2019 | Hasegawa | F23J 13/025 |
| 10,488,077 | B2 * | 11/2019 | Vargo | B29D 23/006 |
| 10,605,454 | B2 * | 3/2020 | Matsunaga | F23J 13/04 |
| 2007/0257487 | A1 * | 11/2007 | Jacklich | F23J 13/04 285/401 |
| 2019/0017701 | A1 * | 1/2019 | Aoki | F23J 13/025 |
| 2020/0284465 | A1 * | 9/2020 | Van Dijk | F16L 29/02 |

FOREIGN PATENT DOCUMENTS

| | | | |
|---|---|---|---|
| KR | 1998034301 | U | 9/1998 |
| RU | 2006754 | C1 | 1/1994 |
| RU | 2110018 | C1 | 4/1998 |
| RU | 2160814 | C2 | 12/2000 |
| RU | 2280215 | C1 | 7/2006 |
| RU | 153204 | U1 | 10/2015 |

OTHER PUBLICATIONS

Office Action of corresponding Russian Patent Application No. 2019125180/06(049178) dated Mar. 3, 2020, 16 pages.

* cited by examiner

EXHAUST DUCT DETACHABLE FROM OUTLET, WATER-HEATING DEVICE HAVING THE EXHAUST DUCT, AND METHOD FOR REPAIRING THE WATER-HEATING DEVICE

CROSS-REFERENCE TO RELATED APPLICATION

This application claims the benefit of priority to Korean Patent Application No. 10-2018-0094937, filed in the Korean Intellectual Property Office on Aug. 14, 2018, the entire contents of which are incorporated herein by reference.

TECHNICAL FIELD

The present disclosure relates to an exhaust duct detachable from an outlet, a water-heating device having the exhaust duct, and a method for repairing the water-heating device.

BACKGROUND

A water-heating device is a device that heats water by transferring, to the water, heat energy generated by burning fuel and air that are injected into the water-heating device. Exhaust gas is generated as a product of the combustion reaction in the water-heating device. The exhaust gas contains harmful substances such as carbon dioxide, nitrogen oxide, sulfur oxide, or the like. Therefore, the exhaust gas should not be discharged without any action indoors and are discharged to the outside after harmful ingredients are removed from the exhaust gas through an after-treatment device.

To discharge the exhaust gas from the water-heating device, a flue extending from the interior of an enclosure, which is a housing of the water-heating device, to the outside is formed. The exhaust gas is led from the interior of the water-heating device to the flue and discharged outside the enclosure through the flue and flows to a predetermined position.

Components received in the enclosure of the water-heating device need to be checked for inspection or repair of the water-heating device. In particular, to efficiently utilize a limited space, the components of the water-heating device may be disposed inside the enclosure such that the components cannot be easily viewed with naked eyes or a worker cannot easily reach the components.

SUMMARY

The present disclosure has been made to solve the above-mentioned problems occurring in the prior art while advantages achieved by the prior art are maintained intact.

An aspect of the present disclosure provides a water-heating device that enables replacement of a heat exchanger even without disassembly of an exhaust adaptor or a flue installed in an outlet, an exhaust duct used in the water-heating device, and a method for repairing the water-heating device.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an exhaust duct includes an upper duct being open at opposite ends thereof and a lower duct being open at a tip end thereof. One end of the upper duct is connected, inside an enclosure of a water-heating device, to an exhaust adaptor disposed on the enclosure, and an opposite end of the upper duct communicates with the tip end of the lower duct. The upper duct is connected to the lower duct so as to be slidable along a reference direction in which the lower duct extends from the tip end of the lower duct, and the upper duct is configured to be separated from the exhaust adaptor by sliding along the reference direction. In an embodiment, an opposite end of the upper duct may communicate with the tip end of the lower duct, such as to form an overlap joint at an overlapping portion.

According to another aspect of the present disclosure, a water-heating device includes an enclosure, a heat exchanger that is received in the enclosure and that causes a combustion reaction of injected fuel and air to generate heat, heats heating water using the generated heat, and discharges exhaust gas generated by the combustion reaction, an exhaust adaptor that is disposed in an outlet formed through the enclosure and that discharges the exhaust gas to the outside, and an exhaust duct including a lower duct and an upper duct, in which the lower duct is connected to the heat exchanger and receives the exhaust gas, and the upper duct is connected to the exhaust adaptor at one end thereof and communicates with the lower duct at an opposite end thereof, such that the exhaust gas flows from the lower duct to the exhaust adaptor and is discharged to the outside. The upper duct is connected to the lower duct so as to be slidable along a direction in which the lower duct extends.

According to another aspect of the present disclosure, provided is a method for repairing a water-heating device that includes an enclosure having an outlet formed therein, an exhaust duct embedded in the enclosure and including a lower duct and an upper duct connected together, a heat exchanger connected to one end of the exhaust duct, and an exhaust adaptor disposed in the outlet and connected with an opposite end of the exhaust duct. The method includes removing one side surface of the enclosure, separating the upper duct from the exhaust adaptor by moving the upper duct along an inner surface of the lower duct, and separating the heat exchanger from the enclosure.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
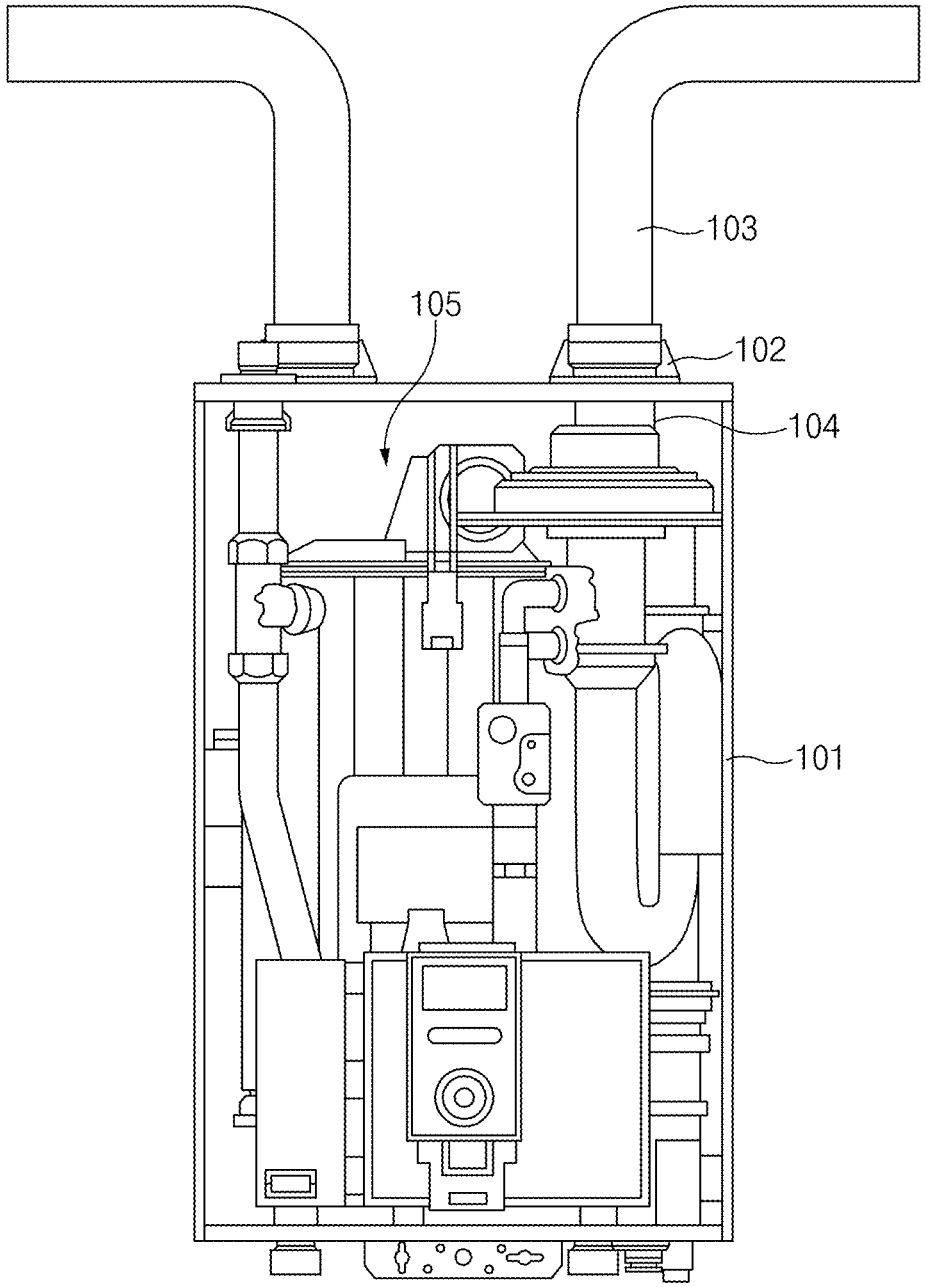
FIG. 1 is a front view illustrating a structure of an exemplary water-heating device.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

Terms, such as "first", "second", "A", "B", "(a)", "(b)", and the like, may be used herein to describe components of the present disclosure. Such terms are only used to distinguish one component from another component, and the substance, sequence, order, or number of these components is not limited by these terms. When a component is described as "connected", "coupled", or "linked" to another component, they may mean the components are not only directly "connected", "coupled", or "linked" but also are indirectly "connected", "coupled", or "linked" via a third component.

FIG. 1 is a front view illustrating a structure of an exemplary water-heating device 100.

Referring to FIG. 1, the exemplary water-heating device 100 includes an enclosure 101, an exhaust adaptor 102 installed in an outlet formed through the enclosure 101, a flue 103 connected to one end of the exhaust adaptor 102 outside the enclosure 101, and an exhaust duct 104 connected to an opposite end of the exhaust adaptor 102 inside the enclosure 101.

In the exemplary water-heating device 100, the flue 103 is coupled to the exhaust adaptor 102 and communicates with the exhaust adaptor 102, and the exhaust duct 104 and the exhaust adaptor 102 are fixedly fastened to each other. Furthermore, the exhaust duct 104 cannot move in any direction in the state of not being separated from the other components connected as illustrated in FIG. 1. Therefore, to separate a heat exchanger 105 from the enclosure 101, the exhaust adaptor 102 and the flue 103 have to be separated from the enclosure 101 after the exhaust adaptor 102 and the flue 103 are disconnected from each other and the exhaust adaptor 102 and the exhaust duct 104 are disconnected from each other. Accordingly, parts may be damaged, or a large amount of time may be taken, in a repair process because the process of separating the exhaust adaptor 102 and the flue 103 from the enclosure 101 is additionally required and the exhaust duct 104 is not easy to separate.

Figure 2:
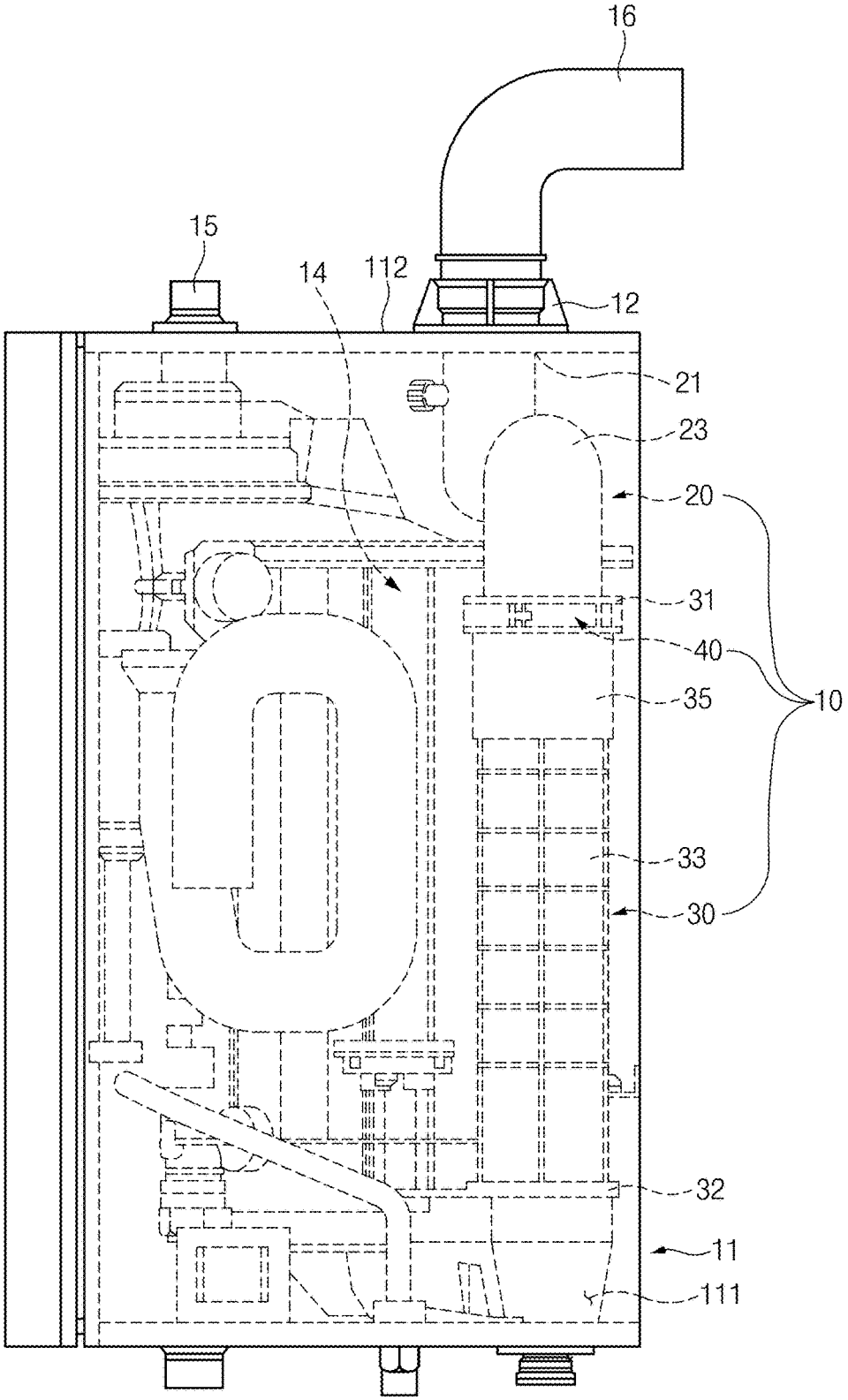
FIG. 2 is a front view illustrating a structure of a water-heating device having an exhaust duct according to an embodiment of the present disclosure.

FIG. 2 is a front view illustrating a structure of a water-heating device 1 having an exhaust duct 10 according to an embodiment of the present disclosure.

Referring to FIG. 2, the water-heating device 1 according to the embodiment of the present disclosure includes an enclosure 11, an exhaust adaptor 12, a flue 16, a heat exchanger 14, and the exhaust duct 10.

The enclosure 11 is a component that accommodates the heat exchanger 14, the exhaust duct 10, and other components, which constitute the water-heating device 1. As illustrated in FIG. 2, the enclosure 11 may be formed in a rectangular parallelepiped box shape. However, the shape of the enclosure 11 is not limited thereto.

Figure 7:
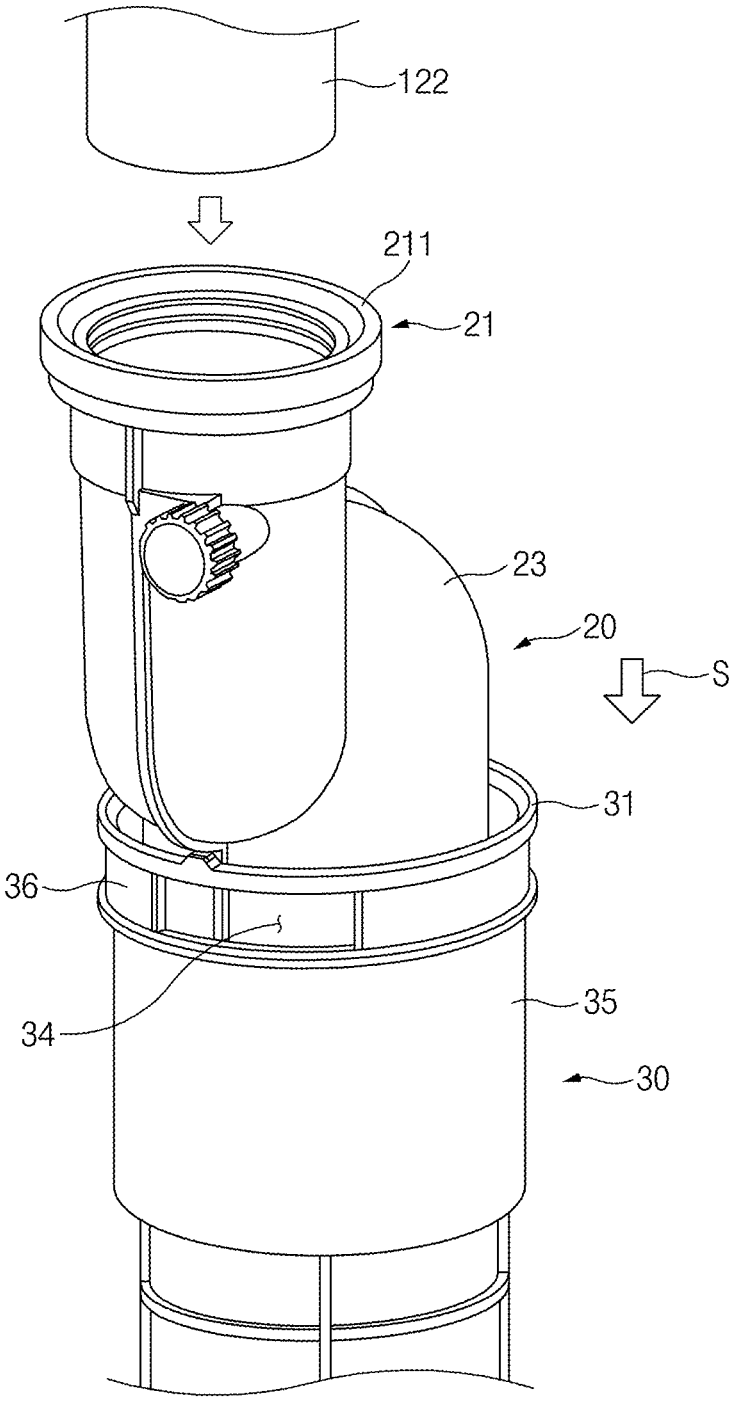
FIG. 7 is a perspective view illustrating a state in which a coupling part of the exhaust duct is separated and the upper duct is slid, according to an embodiment of the present disclosure.

The enclosure 11 has an outlet formed through one side surface thereof, and the exhaust adaptor 12 is disposed in the outlet. Exhaust gas may be discharged from the interior of the enclosure 11 to the outside through the exhaust adaptor 12. The one side surface may be an upper surface 112 located on an upper side with respect to the vertical direction. However, the position of the one side surface is not limited thereto. In addition, the enclosure 11 may have an air inlet 13 (refer to FIG. 7) through which air is supplied into the heat exchanger 14 in the enclosure 11 as illustrated in FIG. 7 and a vent hole 15 through which the air is discharged to the outside to maintain the pressure in the enclosure 11 at an appropriate pressure.

The flue 16 and the upper duct 20 are connected to the exhaust adaptor 12. Accordingly, the exhaust gas flows from the upper duct 20, which will be described below, to the flue 16 through the exhaust adaptor 12 and is discharged to the outside. The flue 16 is a component that is connected with the exhaust adaptor 12 and that discharges the exhaust gas to the outside. One end of the flue 16 is connected with the exhaust adaptor 12 outside the enclosure 11 so that the flue 16 is indirectly connected with the upper duct 20, which will be described below, and an opposite end of the flue 16 is disposed in a predetermined position such that the exhaust gas flows from the one end to the opposite end along a fluid channel formed in a pipe shape between the one end and the opposite end. An outer surface of the one end of the flue 16 is coupled with the exhaust adaptor 12 to seal the interior of the enclosure 11 from the outside.

The exhaust adaptor 12 may be a separate component coupled to the outlet formed through the one side surface of the enclosure 11 as illustrated, but may be a component formed on the one end of the flue 16. In this case, the flue 16 passes through the outlet, and the one end of the flue 16 that corresponds to the exhaust adaptor 12 is directly connected with the upper duct 20.

The heat exchanger 14 is a component that is received in the enclosure 11 and that causes a combustion reaction of injected fuel and air to generate heat, heats heating water using the generated heat, and discharges exhaust gas generated by the combustion reaction. The heated heating water is supplied to a region required to be heated. In the embodiment of the present disclosure, the heat exchanger 14 may be a heat exchanger of a flat fire tube (FFT) type. Accordingly, the heat exchanger 14 and the exhaust duct 10, which will be described below, may be formed in a cylindrical shape extending in one direction, and a space into which a worker's hand or a working tool is inserted may be formed between the exhaust duct 10 and the heat exchanger 14.

The exhaust duct 10 is a component that guides the exhaust gas generated in the heat exchanger 14 toward the flue 16 via the exhaust adaptor 12. A lower end 32 of a lower duct that corresponds to one end of the exhaust duct 10 is connected to the heat exchanger 14, and one end 21 of the upper duct 20 that corresponds to an opposite end of the exhaust duct 10 is connected with the exhaust adaptor 12. Hereinafter, a configuration of the exhaust duct 10 will be described with reference to drawings.

Figure 3:
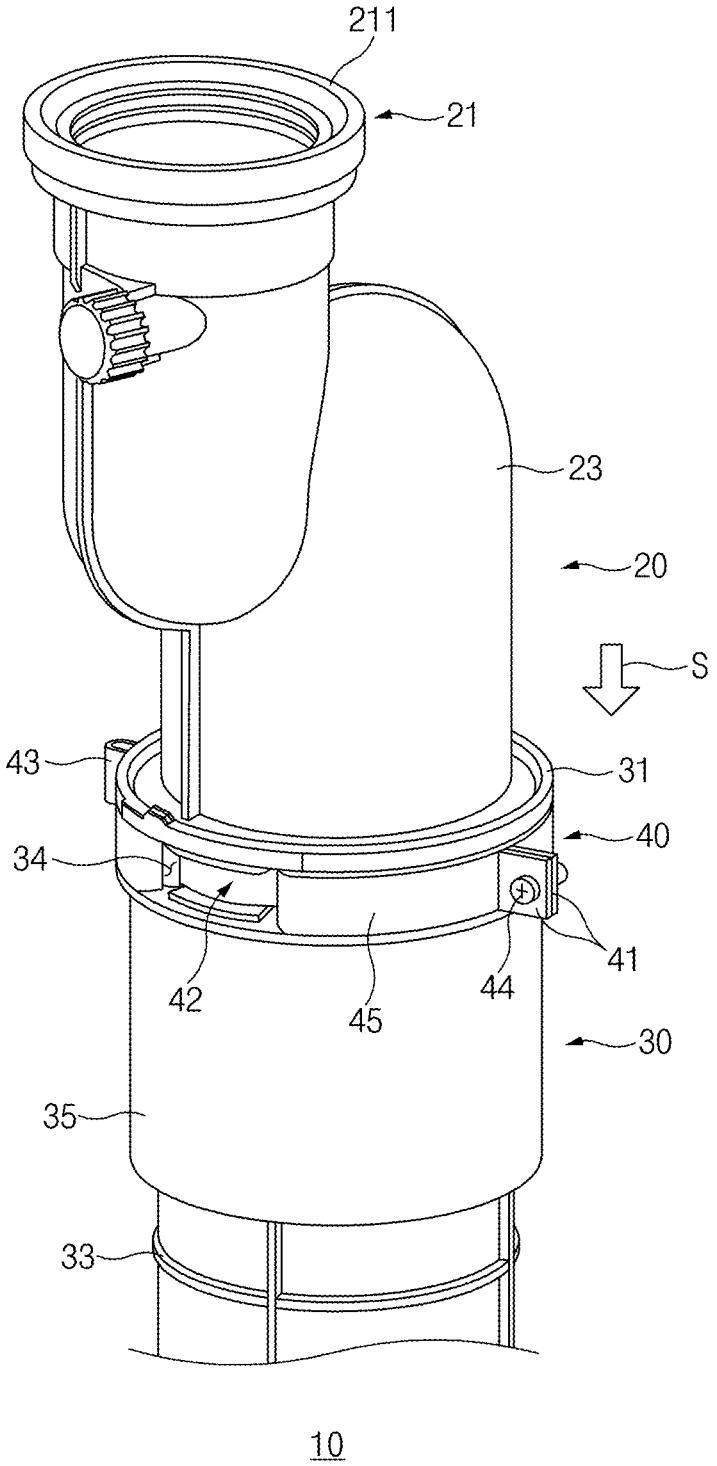
FIG. 3 is a perspective view of the exhaust duct according to an embodiment of the present disclosure.
Figure 4:
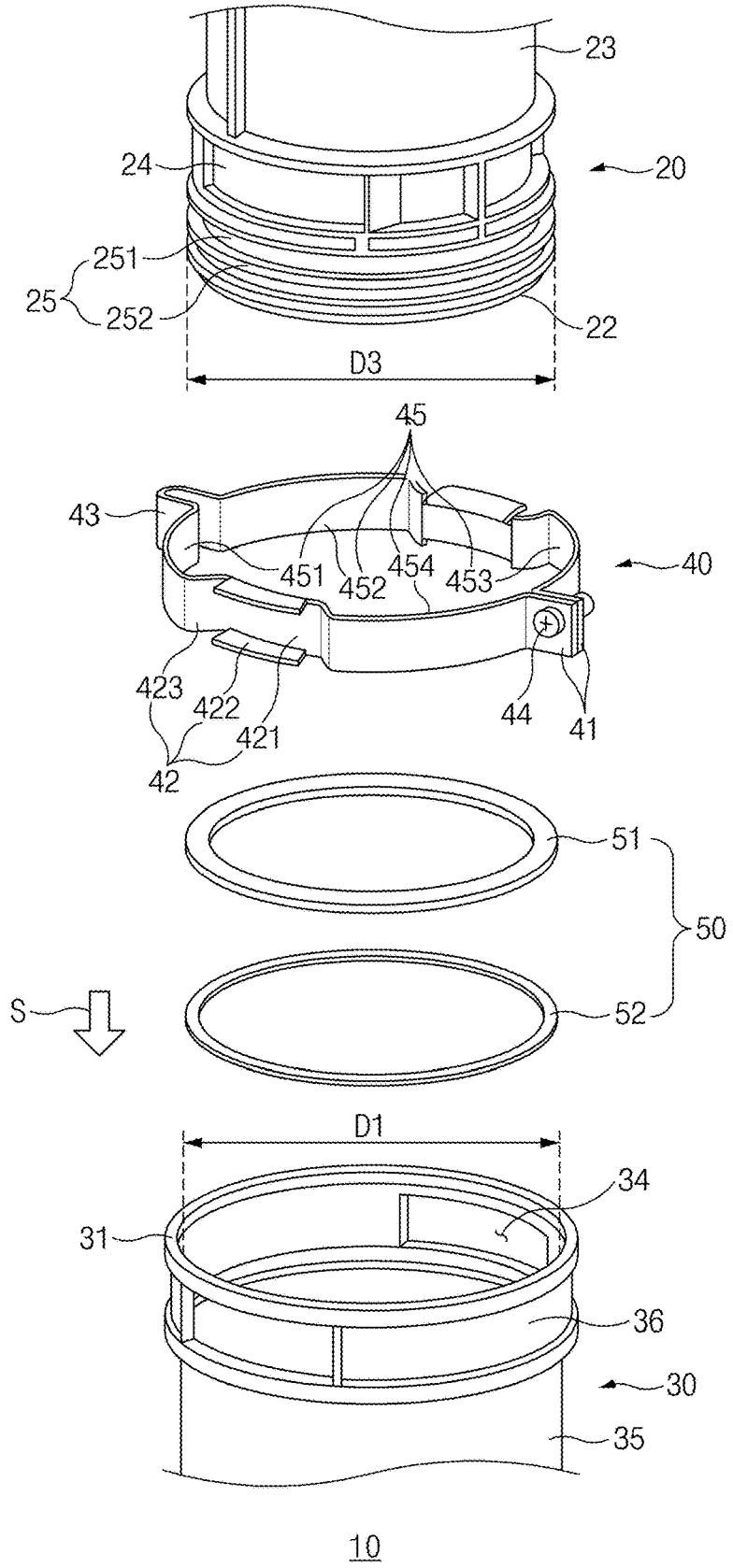
FIG. 4 is an exploded perspective view of the exhaust duct according to the embodiment of the present disclosure.
Figure 5:
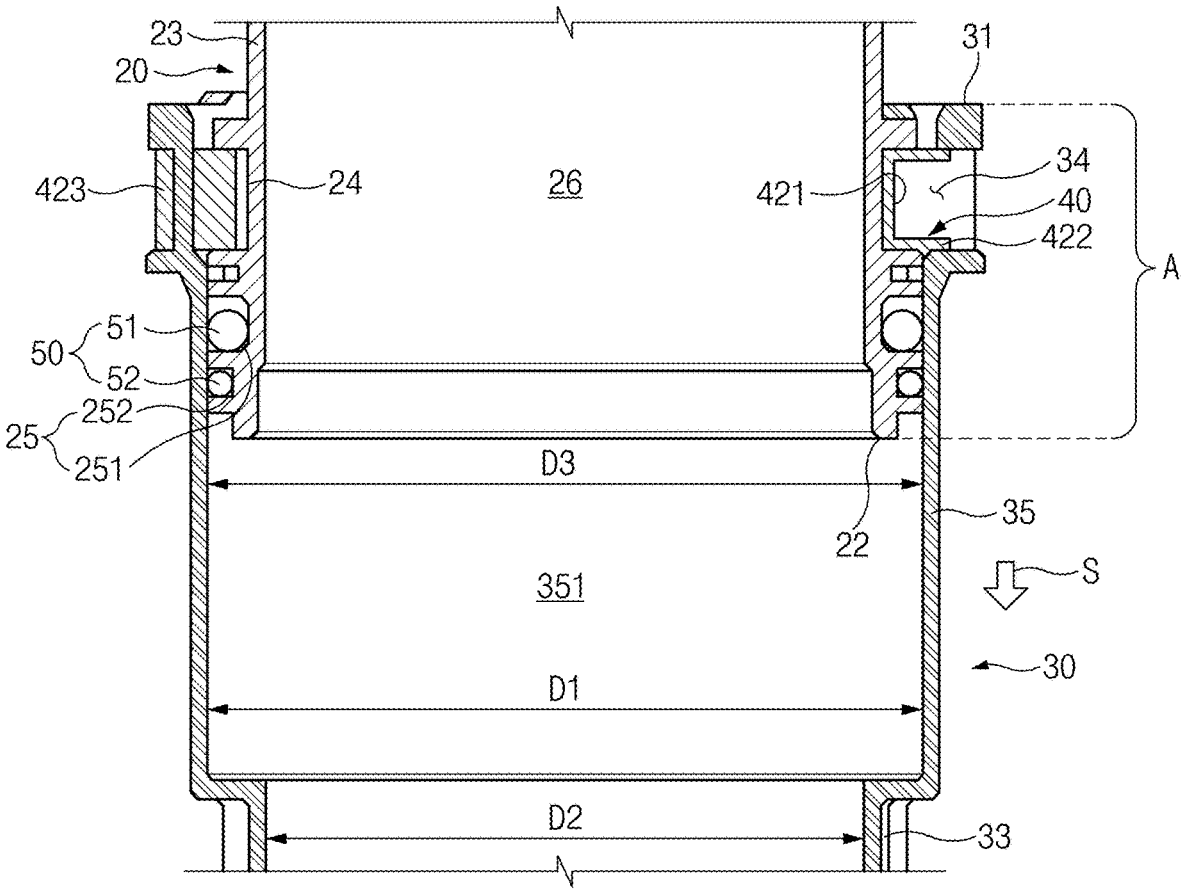
FIG. 5 is a vertical sectional view of the exhaust duct according to the embodiment of the present disclosure.

FIG. 3 is a perspective view of the exhaust duct 10 according to an embodiment of the present disclosure. FIG. 4 is an exploded perspective view of the exhaust duct 10 according to the embodiment of the present disclosure. FIG. 5 is a vertical sectional view of the exhaust duct 10 according to the embodiment of the present disclosure.

Referring to FIGS. 3 to 5, the exhaust duct 10 according to the embodiment of the present disclosure may include the upper duct 20 and the lower duct 30 and may further include a coupling part 40. A reference direction S refers to a direction in which the lower duct 30 extends from a tip end 31 thereof and the upper duct 20 slides so as to be separated from the exhaust adaptor 12. In this specification, the reference direction S refers to a vertically downward direction, but is not limited to the vertical direction.

Upper Duct 20

The upper duct 20 is a component of the exhaust duct 10 that faces the opposite direction to the reference direction S. The upper duct 20 is a pipe that is open at opposite ends 21 and 22. The opposite ends 21 and 22 of the upper duct 20 are connected to different components, respectively. The one end 21 of the upper duct 20 is connected to the exhaust adaptor 12 from inside the enclosure 11 so that the upper duct 20 is indirectly connected with the flue 16. The opposite end 22 of the upper duct 20 communicates with the lower duct 30. Accordingly, the upper duct 20 serves as an intermediate passage through which the exhaust gas from the lower duct 30 is transferred to the exhaust adaptor 12 and the flue 16.

An exhaust sealing member 211 may be provided on the one end 21 of the upper duct 20. The exhaust sealing member 211 may be formed of an elastic material and may surround the periphery of the one end 21 of the upper duct 20. The exhaust sealing member 211 surrounds an inner circumferential surface of the one end 21 of the upper duct 20, and when the exhaust adaptor 12 is inserted into the one end 21 of the upper duct 20, the exhaust sealing member 211 may make contact with an outer circumferential surface of an opposite end 122 (refer to FIG. 6) of the exhaust adaptor 12 inserted. The exhaust sealing member 211 may seal the interior of the upper duct 20 and the interior of the exhaust adaptor 12 because the exhaust sealing member 211 makes contact with the exhaust adaptor 12. To improve the sealing performance, the exhaust sealing member 211 may include a plurality of annular protrusions that protrude inward from the exhaust sealing member 211.

Unlike in the embodiment of the present disclosure, the exhaust sealing member 211 may be formed to surround an outer surface of the one end 21 of the upper duct 20, and the one end 21 of the upper duct 20 may be inserted into the exhaust adaptor 12. Even in this case, the exhaust sealing member 211 may make contact with an inner surface of the exhaust adaptor 12 to seal the interior of the upper duct 20 and the interior of the exhaust adaptor 12.

An intermediate pipe 23 connecting the one end 21 and the opposite end 22 of the upper duct 20 may extend straight in one direction for efficient use of space, but may be a pipe bent a plurality of times as illustrated. However, the shape of the intermediate pipe 23 of the upper duct 20 is not limited thereto.

The upper duct 20 may be connected to the lower duct 30 through the tip end 31 of the lower duct 30, which will be described below, so as to be slidable along the reference direction S and may be separated from the exhaust adaptor 12 by sliding along the reference direction S. The one end 21 of the upper duct 20 may be connected with the exhaust adaptor 12, and the opposite end 22 of the upper duct 20 may be inserted into the lower duct 30 to form an overlapping portion A where the upper duct 20 and the lower duct 30 overlap each other and are coupled together. More specifically, the overlapping portion A refers to a region where the lower duct 30 and the upper duct 20 overlap each other in the state in which the upper duct 20 is inserted into the flue 16.

In the overlapping portion A, the upper duct 20 may have a coupling groove 24 that is cut into an outer surface of the upper duct 20. In the case where the upper duct 20 is formed in a cylindrical shape, the coupling groove 24 may be concavely formed on the outer surface of the upper duct 20 in a radially inward direction along the periphery of the upper duct 20. The coupling part 40 passing through a coupling hole 34 of the lower duct 30, which will be described below, is coupled to the coupling groove 24 to fix the upper duct 20 and the lower duct 30, thereby preventing the upper duct 20 and the lower duct 30 from moving relative to each other in the reference direction S or in the opposite direction to the reference direction S.

Lower Duct 30

The lower duct 30 is a component of the exhaust duct 10 that faces the reference direction S. The tip end 31 that faces the opposite direction to the reference direction S is formed to be open, and the opposite end 22 of the upper duct 20 communicates with the tip end 31. The opposite end 22 of the upper duct 20 is connected to the lower duct 30 through the tip end 31 thereof so as to be slidable in the reference direction S.

The lower duct 30 includes a clearance space part 35 extending from the tip end 31 of the lower duct 30 along the reference direction S. Furthermore, the lower duct 30 includes an extension 33 that extends from the clearance space part 35 along the reference direction S and has an inner diameter D2 smaller than the inner diameter D1 of the clearance space part 35. Accordingly, the components of the lower duct 30 are arranged in the sequence of the clearance space part 35 and the extension 33 along the reference direction S.

The extension 33 extends from the clearance space part and is connected to the heat exchanger 14 of FIG. 2. Accordingly, the exhaust gas discharged from the heat exchanger 14 may be transferred to the clearance space part 35 through the extension 33 and may flow to the upper duct 20 connected to the clearance space part 35.

Referring to FIGS. 4 and 5, the upper duct 20 may have an outer diameter D3 smaller than the inner diameter D1 of the clearance space part 35, and therefore the opposite end 22 of the upper duct 20 may be inserted into the interior 351 of the clearance space part 35. However, the outer diameter D3 of the upper duct 20 may be formed to be larger than the inner diameter D2 of the extension 33, and therefore the upper duct 20 may not be inserted into the extension 33 even though the upper duct 20 slides along the reference direction S. A step may be formed on the border between an inner surface of the extension 33 and an inner surface of the clearance space part 35. The step may stop the upper duct 20 such that the opposite end 22 of the upper duct 20 no longer proceeds along the reference direction S. Because the lower duct 30 has the above-described structure, the upper duct 20 may be inserted into the clearance space part 35 and may slide only in the clearance space part 35.

In the overlapping portion A, the lower duct 30 includes the coupling hole 34 foamed through part of an outer surface thereof. In the case where the lower duct 30 is formed in a cylindrical shape, the coupling hole 34 may be formed in the radial direction along the circumference of the outer surface of the lower duct 30.

Coupling Part 40

The coupling part 40 is a component that fixes the upper duct 20 and the lower duct 30 together. The coupling part 40 may be coupled to the upper duct 20 and the lower duct 30 and may fix the upper duct 20 and the lower duct 30 to prevent the upper duct 20 and the lower duct 30 from moving relative to each other in the reference direction S or the opposite direction to the reference direction S. Because the upper duct 20 is connected to the lower duct 30 so as to be slidable along the reference direction S, the sliding is stopped by the coupling part 40. Furthermore, the coupling part 40 may fix the upper duct 20 and the lower duct 30 to prevent the upper duct 20 and the lower duct 30 from rotating relative to each other about the reference direction S.

In the overlapping portion A, the coupling part 40 is connected to the upper duct 20 and the lower duct 30. Accordingly, the coupling part 40 may fix the region where the upper duct 20 and the lower duct 30 overlap each other. Thus, the size of the coupling part 40 may not be enlarged, and the coupling part 40 has an advantage in sealing the border between the upper duct 20 and the lower duct 30.

The coupling part 40 may be formed in an annular shape that surrounds the upper duct 20 and the lower duct 30 in the overlapping portion A. Specifically, the coupling part 40 may be a member in a strap shape and may be formed in an annular shape that is a closed curve, by combining opposite ends of the coupling part 40 together. The coupling part 40 in an annular shape may surround part of the outer surface of the lower duct 30 and part of the outer surface of the upper duct 20 in the overlapping portion A. The coupling part 40 may include a stopping portion 42, a peripheral portion 45, and a protrusion 43. The components of the coupling part 40 may be connected together to form one member in a strap shape, and the coupling part 40 may be formed in an annular shape by combining opposite ends 41 of the coupling part 40 together.

The peripheral portion 45 is a component of the coupling part 40 that is formed to surround the outer surface of the lower duct 30 in the overlapping portion A in the circumferential direction along at least part of a virtual circumference. Here, the virtual circumference is formed in a shape that surrounds the outer surface of the lower duct 30 in the circumferential direction. Accordingly, the peripheral portion 45 may have an inner surface in a shape corresponding to part of the outer surface of the lower duct 30. The lower duct 30 may further include a peripheral groove 36, into which the peripheral portion 45 is inserted, in the overlapping portion A along the circumferential direction of the lower duct 30 to allow the peripheral portion 45 to be well fixed to the lower duct 30.

The peripheral portion 45 may be implemented with an integrated strap member. However, the peripheral portion 45, as illustrated, may include a plurality of cut-off portions 451, 452, 453, and 454 that are disconnected from each other, but indirectly connected together through other components. Among the plurality of cut-off portions 451, 452, 453, and 454, the cut-off portions 453 and 454 forming the opposite ends 41 of the coupling part 40, as illustrated, may make contact with each other at distal ends thereof and may be indirectly combined with each other through a fastening member 44. The fastening member 44 may be a screw. Two cut-off portions among the plurality of cut-off portions 451, 452, 453, and 454 may be combined with opposite ends of the stopping portion 42, which will be described below, and may be indirectly connected with each other. The two cut-off portions 451 and 452 among the plurality of cut-off portions 451, 452, 453, and 454 may be combined with opposite ends of the protrusion 43, which will be described below, and may be indirectly connected with each other. The cut-off portions 451, 452, 453, and 454 are indirectly connected through the components, and therefore the coupling part 40 may be formed in an annular shape.

The stopping portion 42 is a component that passes through the coupling hole 34 and is inserted into the coupling groove 24 to fix the upper duct 20 and the lower duct 30. The stopping portion 42 is located inward of the virtual circumference on the basis of which the peripheral portion 45 is formed and disposed, and the stopping portion 42 is inserted into the coupling hole 34 formed on the lower duct 30 and the coupling groove 24 formed on the upper duct 20.

The stopping portion 42 is inserted into the coupling groove 24 to fix the upper duct 20 and the lower duct 30 together. Accordingly, when an external force is applied to the upper duct 20 in the reference direction S in the state in which the stopping portion 42 is coupled, a side surface of the coupling groove 24 that faces the opposite direction to the reference direction S presses the stopping portion 42 in the reference direction S. However, the stopping portion 42 is supported by a side surface of the coupling hole 34 that faces the reference direction S and does not move in the reference direction S, and therefore the upper duct 20 also does not move in the reference direction S. In the case where an external force is applied to the upper duct 20 in the opposite direction to the reference direction S, the upper duct 20 does not move in the opposite direction to the reference direction S by an action opposite to that described above. To this end, the stopping portion 42 may include a stopping portion body 421, a connecting portion 423, and a flange 422.

The stopping portion body 421 may be inserted into the coupling groove 24. The stopping portion body 421 is formed in a shape that surrounds a side surface of the coupling groove 24 that faces a radially outward direction of the upper duct 20. The stopping portion body 421 may make contact with the side surface of the coupling groove 24 and may press the upper duct 20 inward. However, the stopping portion body 421 may be spaced apart from the side surface of the coupling groove 24 in the radial direction. The stopping portion body 421 does not need to be formed to surround the entire side surface of the coupling groove 24. The stopping portion body 421 may be formed to surround only part of the side surface of the coupling groove 24.

The stopping portion 42 may include the connecting portion 423 that connects the stopping portion body 421 and the peripheral portion 45. Two connecting portions 423 may be provided because the stopping portion body 421 has to be connected to two cut-off portions 451 and 454 of the peripheral portion 45 that are located on opposite sides of the stopping portion body 421 along the circumferential direction of the lower duct 30. The stopping portion body 421 may be inserted into the coupling groove 24 of the upper duct 20, and the peripheral portion 45 may surround the outer surface of the lower duct 30. Therefore, the connecting portions 423 may extend from opposite ends of the stopping portion body 421 with respect to the circumferential direction of the lower duct 30 along the radially outward direction of the lower duct 30 and the circumferential direction of the lower duct 30. Accordingly, side surfaces of the connecting portions 423 that face the reference direction S and side surfaces of the connecting portions 423 that face the opposite direction to the reference direction S may be placed in contact with the side surfaces of the coupling hole 34 and the coupling groove 24 that face the reference direction S and the side surfaces of the coupling hole 34 and the coupling groove 24 that face the opposite direction to the reference direction S, respectively, to perform the role of the stopping portion 42.

The stopping portion 42 may include the flange 422. The flange 422 may extend along the radial direction of the lower duct 30 and may include two flanges 422. The two flanges 422 may be placed in contact with the side surfaces of the coupling hole 34 and the coupling groove 24 that face the reference direction S and the side surfaces of the coupling hole 34 and the coupling groove 24 that face the opposite direction to the reference direction S, respectively, to perform the role of the stopping portion 42.

The two flanges 422 may extend along the radial direction of the lower duct 30 from one end of the stopping portion body 421 that faces the reference direction S and an opposite end of the stopping portion body 421 that faces the opposite direction to the reference direction S. The two flanges 422 may extend in the radially outward direction of the lower duct 30 because the stopping portion body 421 is inserted into the coupling groove 24.

In the embodiment of the present disclosure, it has been exemplified that the coupling part 40 has the configuration in which the peripheral portion 45 and the stopping portion 42 are connected and the stopping portion 42 includes all of the stopping portion body 421, the connecting portion 423, and the flange 422. However, the coupling part 40 may include only the stopping portion 42 without the peripheral portion 45. Alternatively, various embodiments in which the stopping portion 42 includes only the stopping portion body 421 and the connecting portion 423, the stopping portion 42 includes only the stopping portion body 421 and the flange 422, or the coupling part 40 includes only the peripheral portion 45 and the flange 422 of the stopping portion 42 can be used.

The two cut-off portions 451 and 452, among the plurality of cut-off portions 451, 452, 453, and 454 constituting the peripheral portion 45, may be connected with the protrusion 43. The protrusion 43 may be formed in the shape of "U" by protruding in a convex form from end portions of the two cut-off portions 451 and 452 in the radially outward direction of the lower duct 30. The U-shaped protrusion 43 may impart elasticity to the coupling part 40. The opposite sides of the coupling part 40 may move away from each other, or may move toward each other, with respect to the protrusion 43 and may return to the original positions by a restoring force due to the structure of the protrusion 43. Accordingly, in the state of being separated from the upper duct 20 or the lower duct 30, the coupling part 40 may be coupled to the coupling groove 24 and the coupling hole 34 by spreading the opposite ends 41 of the coupling part 40 and thereafter returning the opposite ends 41 of the coupling part 40 to the original positions by the elasticity.

Sealing Member 50

The sealing member 50 is a component that seals the interior of the lower duct 30 and the interior 26 of the upper duct 20. The sealing member 50 is formed of an elastic material. The sealing member 50 is disposed between the outer surface of the upper duct 20 and the inner surface of the lower duct 30 and simultaneously makes contact with the outer surface of the upper duct 20 and the inner surface of the lower duct 30. The sealing member 50 is formed in an annular shape that surrounds the outer surface of the upper duct 20. The sealing member 50 may remain fixed to the upper duct 20 so as not to separate from the upper duct 20 or hinder sliding of the upper duct 20 when the upper duct 20 slides along the reference direction S.

The sealing member 50 may include a plurality of sealing members to tightly seal the lower duct 30 and the upper duct 20. In an embodiment of the present disclosure, the sealing member 50 includes a total of two sealing members, that is, a first sealing member 51 and a second sealing member 52. However, the number of sealing members is not limited thereto.

The first sealing member 51 and the second sealing member 52 may be sequentially disposed along the reference direction S and may have different diameters in a vertical section cut by a plane including the reference direction S. In an embodiment of the present disclosure, the diameter of the vertical cross-section of the first sealing member 51 is illustrated as being larger than the diameter of the vertical cross-section of the second sealing member 52. However, the relationship is not limited thereto. A seal groove 25 may be formed on the outer surface of the upper duct 20 to receive the sealing member 50 therein. The seal groove 25 may be concavely formed in the radially inward direction of the upper duct 20. The seal groove 25 may include a first seal groove 251 and a second seal groove 252 in which the first sealing member 51 and the second sealing member 52 are received, respectively.

Hereinafter, a method of repairing the water-heating device 1 will be described with reference to drawings.

A method of repairing the water-heating device 1 according to an embodiment of the present disclosure begins with a step of removing another side surface rather than the upper surface 112, which is one side surface through which the outlet is formed, among side surfaces of the enclosure 11 illustrated in FIG. 2. The side surface of the enclosure 11 that is removed may be, but is not limited to, a front surface 111 that is a side surface perpendicular to the reference direction S.

After the side surface of the enclosure 11 is removed, a step of removing cable ties and bolts for fixing various types of pipes and interconnection wires may be performed. A step of removing a harness for fixing main functional parts and a step of removing a controller electrically connected to various parts of the water-heating device 1 to transfer control signals may be performed. A step of removing a fan and a mix chamber of a burner and a step of separating other pipes may be performed. The coupling relationship between the enclosure 11 and the remaining components other than the exhaust duct 10 may be removed through the processes described above.

Figure 6:
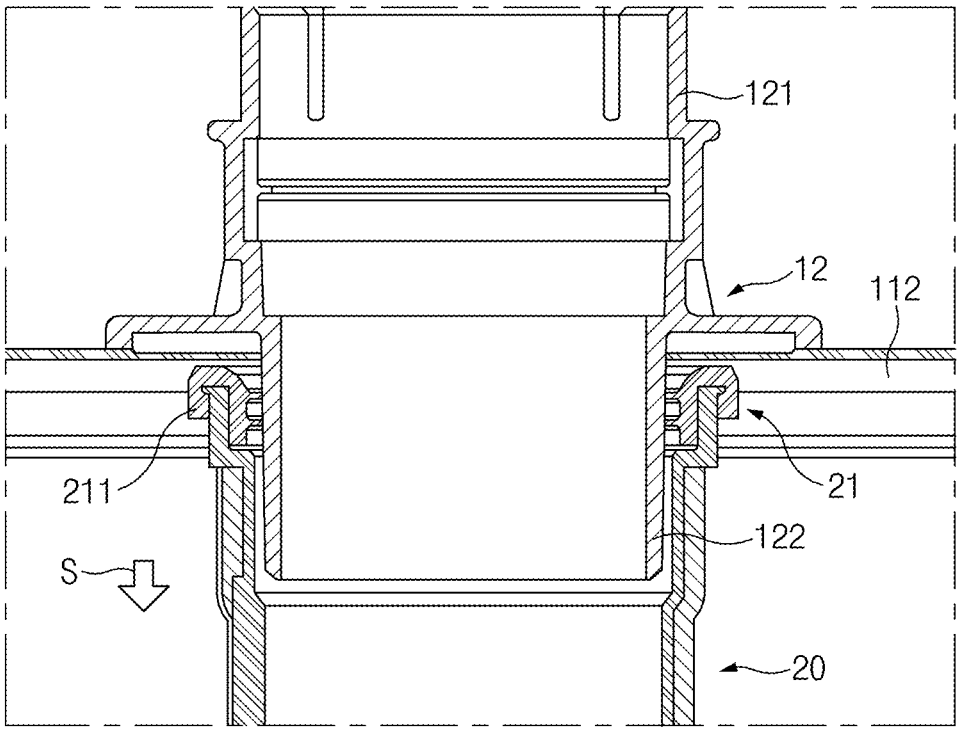
FIG. 6 is a vertical sectional view illustrating a form in which an upper duct is connected with an exhaust adaptor according to an embodiment of the present disclosure.

FIG. 6 is a vertical sectional view illustrating a form in which the upper duct 20 is connected with the exhaust adaptor 12 according to an embodiment of the present disclosure.

The flue 16 is connected to one end 121 of the exhaust adaptor 12 that is located outside the enclosure 11, and the one end 21 of the upper duct 20 is connected to the opposite end 122 of the exhaust adaptor 12 that is located inside the enclosure 11. Accordingly, the exhaust gas may be transferred from the upper duct 20 to the flue 16 through the exhaust adaptor 12 and may be discharged to the outside. The exhaust adaptor 12 may be formed to surround the outlet. The one end 121 of the exhaust adaptor 12 may protrude in the direction perpendicular to the upper surface 112, and the opposite end 122 of the exhaust adaptor 12 may protrude in the direction opposite to the one end 121 of the exhaust adaptor 12.

The opposite end 122 of the exhaust adaptor 12, as illustrated, may be inserted into and connected with the one end 21 of the upper duct 20. The exhaust sealing member 211 presses the opposite end 122 of the exhaust adaptor 12 inward to seal the interior of the upper duct 20 and the interior of the exhaust adaptor 12.

Figure 8:
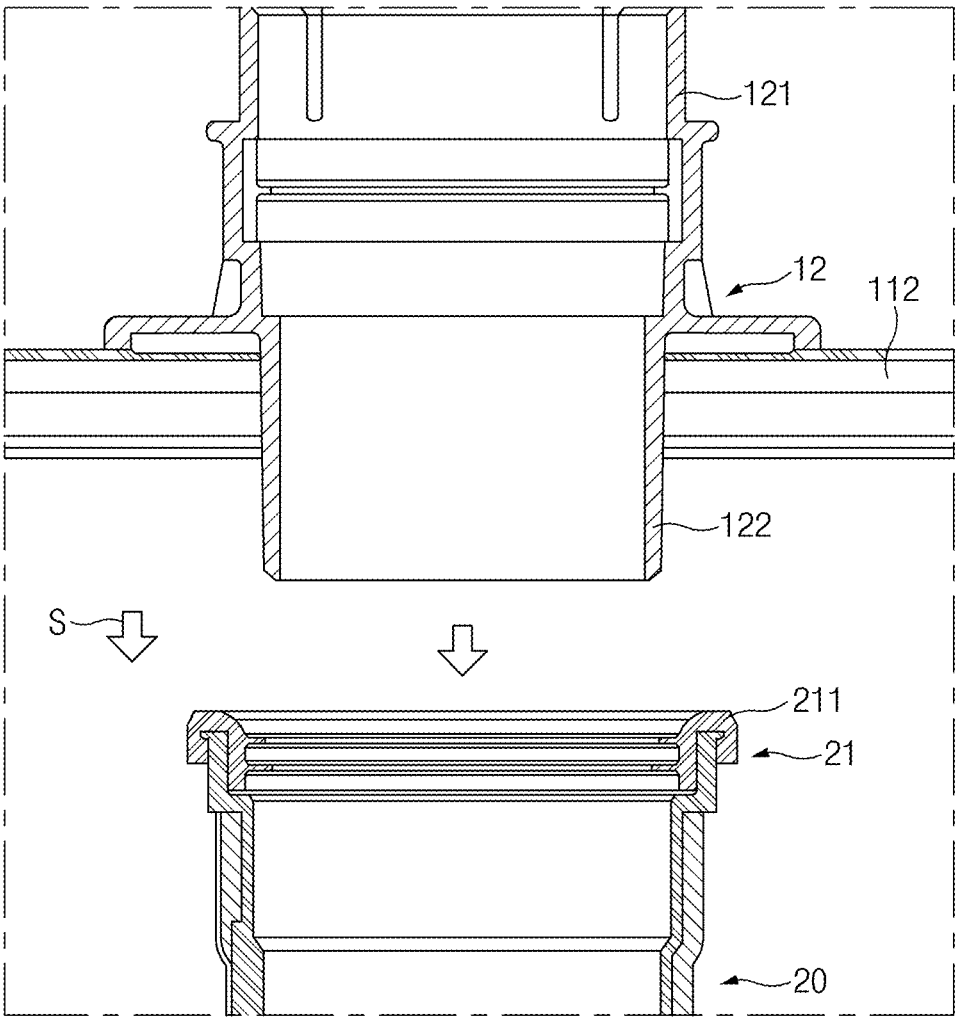
FIG. 8 is a vertical sectional view illustrating a position relationship between the upper duct and the exhaust adaptor of FIG. 7.

FIG. 7 is a perspective view illustrating a state in which the coupling part 40 of the exhaust duct 10 is separated and the upper duct 20 is slid, according to an embodiment of the present disclosure. FIG. 8 is a vertical sectional view illustrating a position relationship between the upper duct and the exhaust adaptor of FIG. 7.

A step of removing the coupling part 40 that fixes the upper duct 20 and the lower duct 30 may be performed to allow the upper duct 20 to move relative to the lower duct 30. Because the opposite ends 41 of the coupling part 40 are combined by the fastening member 44 in the embodiment of the present disclosure, the coupling part 40 may be separated from the lower duct 30 by removing the fastening member 44 and spreading the opposite ends 41 of the coupling part 40.

Because the coupling part 40 is removed, the upper duct 20 may slide relative to the lower duct 30. Accordingly, a step of separating the upper duct 20 from the exhaust adaptor 12 by moving the upper duct 20 along the inner surface of the clearance space part 35 included in the lower duct 30 may be performed. The upper duct 20 slides in the lower duct 30 in the reference direction S, and therefore the one end 21 of the upper duct 20 that is connected with the exhaust adaptor 12 is separated from the exhaust adaptor 12.

Figure 9:
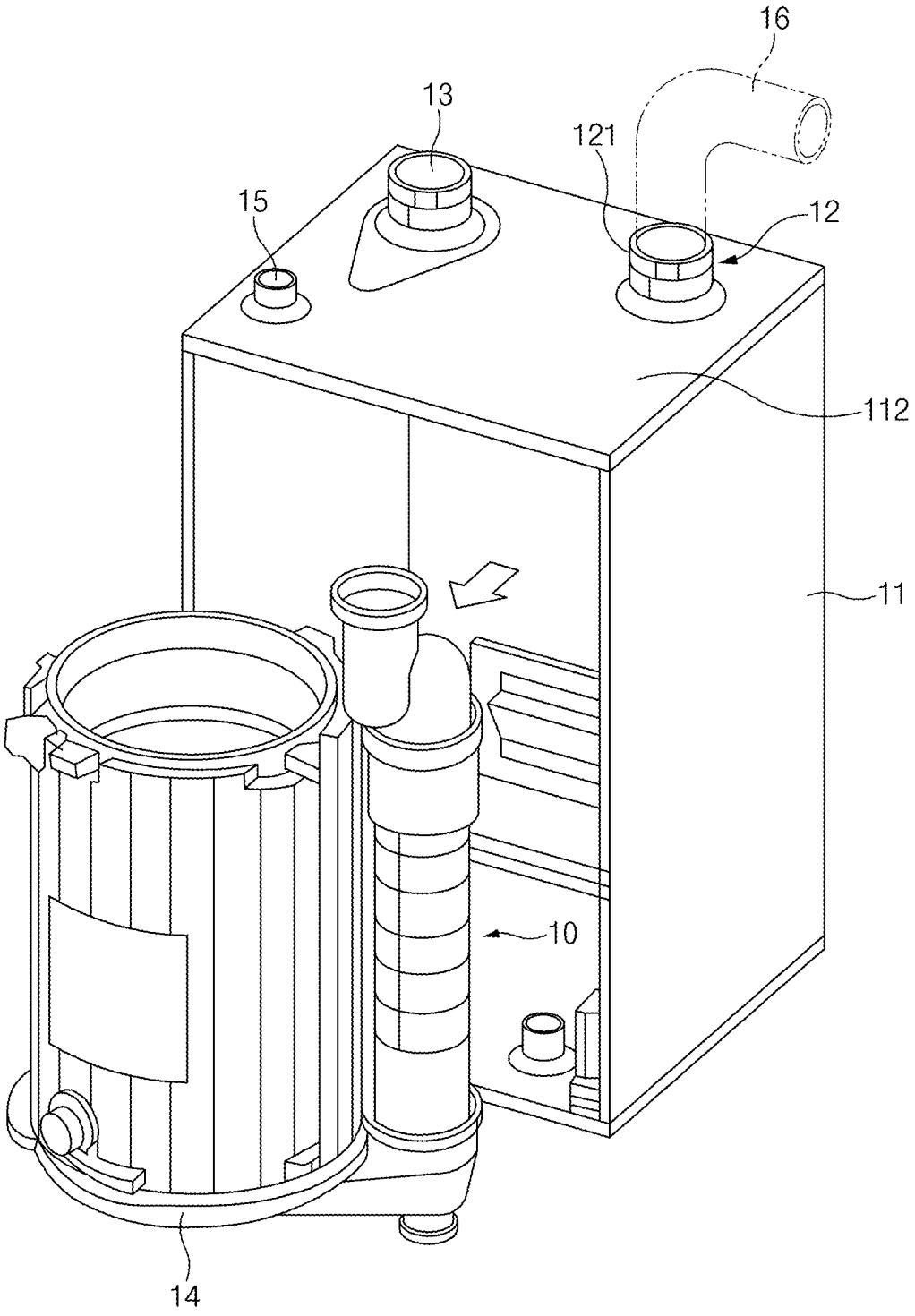
FIG. 9 is a perspective view illustrating a situation in which a heat exchanger and the exhaust duct are separated from an enclosure according to an embodiment of the present disclosure.

FIG. 9 is a perspective view illustrating a situation in which the heat exchanger 14 and the exhaust duct 10 are separated from the enclosure 11 according to an embodiment of the present disclosure.

The upper duct 20 is separated from the exhaust adaptor 12, and therefore no component having a coupling relationship with the enclosure 11 or the exhaust adaptor 12 remains inside the enclosure 11. Accordingly, a step of separating the heat exchanger 14, with which the exhaust duct 10 is combined, from the enclosure 11 through the side surface may be performed. The heat exchanger 14 separated from the enclosure 11 may be provided for repair, and a worker may easily repair the components of the water-heating device 1 and may prevent damage to the components of the water-heating device 1 in the repair process.

Accordingly, the heat exchanger may be easily separated from the enclosure and provided for repair. Thus, a worker may easily repair the components of the water-heating device, and damage to the components of the water-heating device in the repair process may be prevented.

Hereinabove, even though all of the components are coupled into one body or operate in a combined state in the description of the above-mentioned embodiments of the present disclosure, the present disclosure is not limited to these embodiments. That is, all of the components may operate in one or more selective combination within the range of the purpose of the present disclosure. It should be also understood that the terms of "include", "comprise" or "have" in the specification are "open type" expressions just to say that the corresponding components exist and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

The invention claimed is:

1. An exhaust duct comprising:

an upper duct being open at opposite ends thereof, wherein one end of the upper duct is connected, inside an enclosure of a water-heating device, to an exhaust adaptor disposed on the enclosure;

a lower duct being open at a tip end thereof, wherein an opposite end of the upper duct communicates with the tip end of the lower duct to form an overlap joint at an overlapping portion; and a coupling part connected to the upper duct and the lower duct, the coupling part being configured to fix the upper duct and the lower duct to prevent the upper duct from sliding relative to the lower duct, wherein the upper duct is connected to the lower duct so as to be slidable along a first direction in which the lower duct extends from the tip end of the lower duct, and the upper duct is configured to be separated from the exhaust adaptor by sliding along the first direction, wherein the coupling part is connected to the upper duct and the lower duct in the overlapping portion that is a region in which the upper duct and the lower duct overlap each other in a direction perpendicular to the first direction, wherein in the overlapping portion, the lower duct includes a coupling hole formed through part of an outer surface of the lower duct, wherein in the overlapping portion, the upper duct includes a coupling groove concavely formed in a radially inward direction, and wherein the coupling part includes a stopping portion configured to fix the upper duct and the lower duct by being inserted into the coupling groove through the coupling hole.

2. The exhaust duct of claim 1, wherein the coupling part further includes a peripheral portion formed to surround the outer surface of the lower duct in the overlapping portion in a circumferential direction along at least part of a virtual circumference, wherein the stopping portion is located inward of the virtual circumference and inserted into the coupling hole and the coupling groove, and wherein the peripheral portion and the stopping portion are connected together such that the coupling part forms a closed curve.

3. The exhaust duct of claim 2, wherein the stopping portion includes:

a stopping portion body inserted into the coupling groove and formed to surround a side surface of the coupling groove that faces a radially outward direction of the lower duct; and two connecting portions extending from opposite ends of the stopping portion body with respect to the circumferential direction of the lower duct along a radially outward direction of the lower duct and the circumferential direction of the lower duct, the two connecting portions being configured to connect the peripheral portion and the stopping portion body.

4. The exhaust duct of claim 2, wherein the stopping portion includes two flanges extending along a radial direction of the lower duct, the two flanges being configured to make contact with side surfaces of the coupling hole and the coupling groove that face the first direction and to make contact with side surfaces of the coupling hole and the coupling groove that face an opposite direction to the first direction.

5. The exhaust duct of claim 2, wherein the peripheral portion further includes:

two cut-off portions disconnected from each other and indirectly connected together; and a protrusion configured to connect the two cut-off portions, the protrusion being formed in a convex form in a radially outward direction of the lower duct from the two cut-off portions to impart elasticity to the coupling part.

6. The exhaust duct of claim 1, wherein the stopping portion includes:

a stopping portion body formed to surround a side surface of the coupling groove that faces a radially outward direction of the lower duct; and two flanges extending, along a radial direction of the lower duct, from one end of the stopping portion body that faces the first direction and an opposite end of the stopping portion body that faces an opposite direction to the first direction, the two flanges being configured to make contact with side surfaces of the coupling hole and the coupling groove that face the first direction.

7. The exhaust duct of claim 6, wherein the stopping portion body is inserted into the coupling groove, and wherein the flanges extend from the stopping portion body in a radially outward direction of the lower duct.

8. The exhaust duct of claim 1, wherein the coupling part is formed in an annular shape by combining opposite ends of the coupling part and surrounds part of an outer surface of the lower duct and part of an outer surface of the upper duct in the overlapping portion.

9. The exhaust duct of claim 1, wherein the opposite end of the upper duct is inserted into the lower duct, and wherein the exhaust duct further comprises a sealing member disposed between an outer surface of the upper duct and an inner surface of the lower duct and configured to simultaneously make contact with the outer surface of the upper duct and the inner surface of the lower duct to seal the interior of the lower duct and the interior of the upper duct.

10. The exhaust duct of claim 1, wherein the lower duct includes:

a clearance space part extending from the tip end of the lower duct along the first direction; and an extension extending from the clearance space part along the first direction and having an inner diameter smaller than an inner diameter of the clearance space part.

11. The exhaust duct of claim 10, wherein the upper duct has an outer diameter that is smaller than the inner diameter of the clearance space part and larger than the inner diameter of the extension, and the upper duct is connected to the clearance space part such that the upper duct is inserted into the clearance space part and slides in the clearance space part.

12. The exhaust duct of claim 1, wherein the exhaust adaptor is inserted into the one end of the upper duct, and wherein the upper duct includes, on the one end thereof, an exhaust sealing member configured to surround and make contact with an outer surface of the inserted exhaust adaptor to seal the interior of the upper duct and the interior of the exhaust adaptor.

13. A water-heating device comprising:

an enclosure;

a heat exchanger received in the enclosure, the heat exchanger being configured to heat heating water using a generated heat generated by a combustion reaction of injected fuel and air, and discharge exhaust gas generated by the combustion reaction;

an exhaust adaptor disposed in an outlet formed through the enclosure, the exhaust adaptor being configured to discharge the exhaust gas to the outside; and an exhaust duct including a lower duct, an upper duct and a coupling part, wherein the lower duct is connected to the heat exchanger and receives the exhaust gas, and the upper duct is connected to the exhaust adaptor at one end thereof and communicates with the lower duct at an opposite end thereof, such that the exhaust gas flows from the lower duct to the exhaust adaptor and is discharged to the outside, wherein the upper duct is connected to the lower duct to form an overlap joint at an overlapping portion so as to be slidable along a first direction in which the lower duct extends, wherein the coupling part is connected to the upper duct and the lower duct, the coupling part being configured to fix the upper duct and the lower duct to prevent the upper duct from sliding relative to the lower duct, wherein the coupling part is connected to the upper duct and the lower duct in the an overlapping portion that is a region in which the upper duct and the lower duct overlap each other in a direction perpendicular to the first direction, wherein in the overlapping portion, the lower duct includes a coupling hole formed through part of an outer surface of the lower duct, wherein in the overlapping portion, the upper duct includes a coupling groove concavely formed in a radially inward direction, and wherein the coupling part includes a stopping portion configured to fix the upper duct and the lower duct by being inserted into the coupling groove through the coupling hole.

14. The water-heating device of claim 13, wherein the one end of the upper duct is configured to be separated from the exhaust adaptor by sliding the upper duct in the first direction away from the exhaust adaptor.

15. A method for repairing a water-heating device that includes an enclosure having an outlet formed therein, an exhaust duct embedded in the enclosure and including a lower duct and an upper duct connected together to form an overlap joint at an overlapping portion, a heat exchanger connected to one end of the exhaust duct, and an exhaust adaptor disposed in the outlet and connected with an opposite end of the exhaust duct, the method comprising:

removing one side surface of the enclosure;

removing a coupling part configured to fix the upper duct and the lower duct by connecting the upper duct and the lower duct in the overlapping portion that is a region in which the upper duct and the lower duct form the overlap joint in a direction perpendicular to a first direction, such that the upper duct moves in the first direction relative to the lower duct;

separating the upper duct from the exhaust adaptor by moving the upper duct along an inner surface of the lower duct; and separating the heat exchanger from the enclosure, wherein in the overlapping portion, the lower duct includes a coupling hole formed through part of an outer surface of the lower duct, wherein in the overlapping portion, the upper duct includes a coupling groove concavely formed in a radially inward direction, and wherein the coupling part includes a stopping portion configured to fix the upper duct and the lower duct by being inserted into the coupling groove through the coupling hole.

* * * * *